United States Patent [19]

Boogaards-Könnecker

[11] Patent Number: 4,931,377

[45] Date of Patent: Jun. 5, 1990

[54] METHOD OF PRODUCING A SELF-SUPPORTING FILM BEARING A POSITIVE PHOTOGRAPHIC IMAGE AND HAVING AN OVERALL THICKNESS OF LESS THAN 50 μM

[76] Inventor: Henriette S. Boogaards-Könnecker, Hageland 22, 4641 RZ Ossendrecht, Netherlands

[21] Appl. No.: 347,250

[22] Filed: May 3, 1989

Related U.S. Application Data

[63] Continuation of Ser. No. 129,968, Dec. 4, 1987, abandoned, which is a continuation of Ser. No. 828,180, Feb. 11, 1986, abandoned.

[30] Foreign Application Priority Data

Aug. 14, 1985 [EP] European Pat. Off. ..... 85201310.1

[51] Int. Cl.[5] ..... G03C 11/12

[52] U.S. Cl. ..... 430/256; 430/406; 430/495; 430/538; 430/939

[58] Field of Search ..... 430/256, 939, 495, 406, 430/538

[56] References Cited

FOREIGN PATENT DOCUMENTS 3962 of 1912 United Kingdom .

*Primary Examiner*—Jack P. Brammer
*Attorney, Agent, or Firm*—Ladas & Parry

[57] ABSTRACT

A method of producing a self-supporting film carrying a positive photographic image is provided, comprising splitting an image-carrying positive photographic film in a manner known per se and removing remaining adhering paper residues from the image part and using the so obtained image part as the self-supporting film having thickness of less than 50 μm. Also embodiments are shown for carrying out this process continuously.

8 Claims, 1 Drawing Sheet

Figure 1:
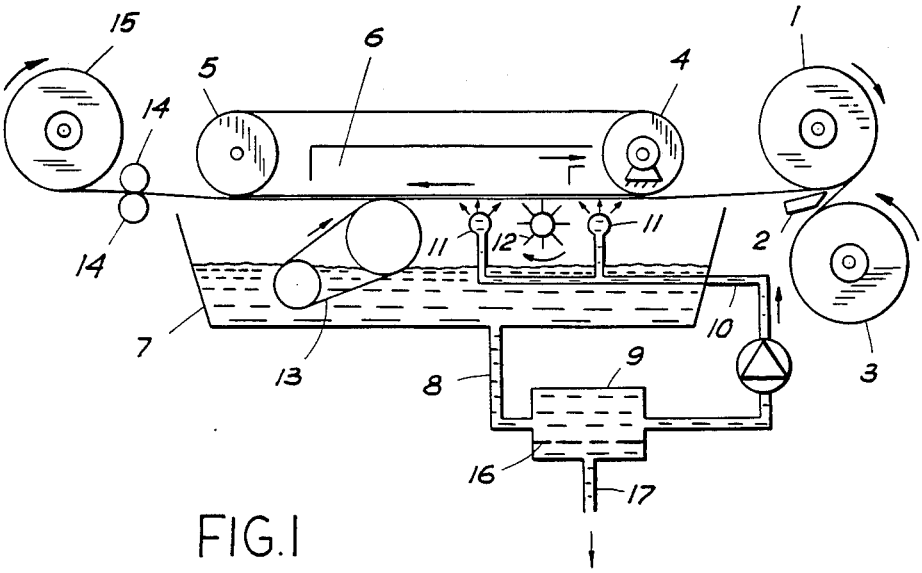

METHOD OF PRODUCING A SELF-SUPPORTING FILM BEARING A POSITIVE PHOTOGRAPHIC IMAGE AND HAVING AN OVERALL THICKNESS OF LESS THAN 50 μM

This is a continuation of co-pending application Ser. No. 07/129,968 filed on December 4, 1987, now abandoned, which is a continuation of Ser. No. 06/828,180 filed on February 11, 1986, now abandoned.

This invention relates to a process for producing unextremely thin positive photographic image, useful for showing with transmitted light. Ultrathin films bearing a positive photographic image are used for instance for sticking to linen or the like, the visual effect being better, the thinner the film is and the cleaner the reverse side thereof. Furthermore, there is a need for this kind of films for showing advertisment pictures in public places, busses, coaches and the like. For this last mentioned purpose there is a kind of apparatuses available, wherein only films can be used which may have a thickness of no more than some tens of μm. Films for this purpose up till now could only be produced according to an expensive and specialistic printing process. However, even in apparatuses which per se permit the use of thicker films, one should still use such thin films in practice, because otherwise much less images could be introduced in the apparatus.

Furthermore, paper is excluded as support for the image, because this will "creep" in the film container under influence of the exposure to light.

During some time a special splittable photographic paper was sold commercially by 3 M Company; this paper could be splitted easily in such a way that the image layer (mainly containing the photographic emulsion) remained. Of course, this specialistic paper was expensive. Applicant does not know how this paper was produced, but experience with this paper has taught applicant that the remaining image film is highly electrostatic. Anyway, it appeared in the meantime that this paper no longer is sold, so that there was a problem to find a process with which a thin film could be obtained to which an image has been applied in a simple and relatively cheap photographic way.

On the other hand, it should be stressed that the paper commercially available from 3 M Company was intended to give a product which could be glued to some support, preferably different from paper. Also in the patent literature various processes have been disclosed for producing thin films bearing a positive photographic image. However, all such processes were intended to obtain a final product, wherein this film is attached to a support. Thus, EU-A-0101261 discloses a process, wherein the paper layer of a photographic print is stripped off mechanically, whereafter the remaining paper fibers are removed with for instance aqueous sodium hydroxide. However, these steps are carried out after the complete photograph print has been laminated with its image side to the back of a base, and the final product of the process contains even 8 layers. Similar processes are disclosed in DE-A-2,447,768, wherein also the paper layers are removed after the image side of the print has been attached to a support. Also according to FR-A-1,513,828 the paper layers of the print are only removed after the image side has been attached to a support, whereas as an alternative the possibility is discussed of removing the paper layers without prior applying a support, but in that case one has to work at 160° C. and a relative humidity of less than 50%, in order to separate the glue layer and the image layer.

Also according to NL-A-8105780 of the same applicant a positive photographic image is produced, and the support layers are removed, for instance by cautiously scouring, whereafter the image side is protected with a transparant foil and the other side is glued to a transparant foil of artificial resin, which now functions as the support. In that application also reference is made to the well-known technique to remove the support layers from a photographic emulsion and glueing it to linen or the like. Of course, in that last mentioned case it is not essential that all paper residues have been removed.

Even though in some of the above-discussed cases self-supporting films carrying a positive photographic image and having a thickness of less than 50 μm may have been obtained as intermediate products, nobody has thought of using such a thin transparant, image-bearing film per se. Surprisingly, it has now been found that such thin films can be used per se and are especially useful in the above-mentioned apparatuses for showing advertisements and the like for which up till now only the films make according to the expensive and specialistic printing process were suitable, and that it is possible with relatively simple means to produce these films in such a way that they meet all the requirements for this use. An important condition to be fulfilled is that the paper residues are substantially completely removed from the film and preferably are removed for 100%.

Accordingly, this invention provides a method of producing a self-supporting film bearing a positive photographic image, comprising splitting and image-carrying positive photographic film in a manner known per se and removing remaining adhering paper residues from the image part, and using the so obtained image part as the self-supporting film having a thickness of less than 50 μm.

Preferably, the thickness of the final film is about 30–40 μm.

Various practical possibilities exist for carrying out this process.

Splitting of the film may be carried out by hand with the aid of a sharp knife. Once a small area has been split, the layers may simply pulled apart by hand. However, for a production on any reasonable scale it is more practical to carry this out mechanically with the aid of a knife which has been adjusted at the right height and is driven into the paper with the aid of rolls and claws.

Any positive photographic paper is useful for the present method. A very suitable commercial kind is the high gloss paper of Kodak.

The split, image-carrying product is not yet suitable for showing with transmitted light, because there is still too much paper residue on its back. Now there are various possibilities of removing these paper residues. As indicated in the above-discussed EU-A-0,101,261, this can be done with sodium hydroxide, although it is not disclosed therein how exactly this should be done. Of course, one should take into account that the image itself should not come into contact with the sodium hydroxide, because it is then immediately spoiled. Also the product should be free of pinholes, because otherwise sodium hydroxide applied to the back might penetrate into the image itself. For production on a small scale careful brushing with dilute sodium hydroxide is possible. However, for large scale production more sophisticated means should be used.

A suitable system for this embodiment will discussed hereinafter with reference to FIG. 1 of the accompanying drawings.

FIG. 1 is a sectional view of the embodiment.

This embodiment relates to a method wherein the removal of the paper residues is carried out by spraying water or aqueous sodium hydroxide in upward direction against the split part of the film which is moving with the image side upward over the open mesh belt. A suitable apparatus is shown in FIG. 1 in sectional view. A film carrying a positive photographic image is wound from stock roll 1 and passes over a knife 2 which splits the film into an image part and a backing part, consisting predominantly of paper. This last part is wound on roll 3. The image part is passed with the image directed upwardly to a conveyor containing rolls 4 and 5 of which roll 4 is the drive roll. The conveyor belt contains apertures and adjacent to a section of the belt is the vacuum chamber 6 where a vacuum is drawn in order to assure that the split film is maintained in a flat position.

Below the belt is a tank 7 containing some suitable liquid, for instance water or aqueous sodium hydroxide or some other suitable solvent for the paper. If desired, the liquid may be heated by some suitable means (not shown). The liquid passes through line 8 to tank 9, from where it is pumped to manifold 10 provided with nozzles 11 of which for simplicity's sake only two have been shown. The spraying action of the nozzles on the paper residues may be enhanced, if desired, by one or more rotating brushes 12, and if desired, one may use instead thereof or together therewith a sanding belt 13. Since this belt is passing through the liquid, it has in fact a scouring action on the paper residues.

In order to prevent the liquid of contacting the image side of the thin film, the film is passed with a small overlap over the liquid pass. This means that the edges thereof remain untreated and have to be cut off. This is done with some suitable knife at 14. Thereafter, the film is wound on a roll 15. Of course, when aqueous sodium hydroxide is used as treating liquid, the treated side of the film first has to be rinsed before being wound up. Also the film should be dried and to this end it is passed to a suitable drying station.

At some suitable place in line 8 a filtering device 16 is present (indicated schematically) and paper pulp may be removed through an exit line 17, provided with some suitable valve (not shown).

In as far an aqueous liquid is used for the treatment according to the above embodiment, a drying station will be necessary, which requires additional space. If a volatile organic solvent is used, either in the treating bath or for rinsing the film after treatment with an aqueous liquid, distillation means have to be provided for recovering the organic solvent. For all these reasons this embodiment although allowing for continuous production, it is not the most preferable embodiment for large scale production.

Figure 2:
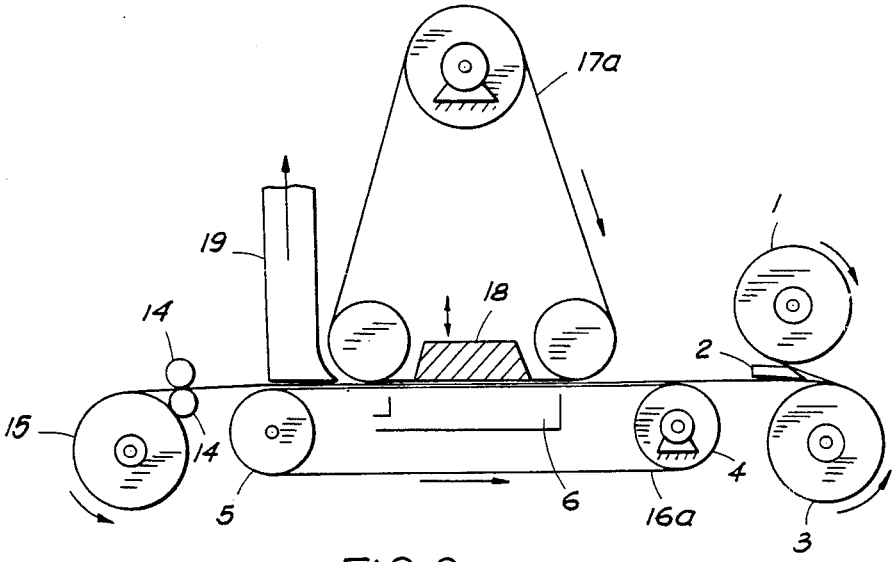

A preferred embodiment for large scale production is shown in FIG. 2. According to this embodiment the removal of the paper residues is carried out continuosly by grinding with sand paper, while the split image part of the film is moving with the image downwards over an endless belt and is kept level by drawing vacuum through apertures in the belt.

More specifically, as shown in FIG. 2, the complete film is wound again from stock roll 1, split with the knife 2 and the paper side of the film is wound on roll 3, just like in FIG. 1. The image part of the film is passed to the conveyor belt with rolls 4 and 5 like in FIG. 1, but this time the conveyor belt is positioned below the film and the image is on the downward side of the split film facing the belt. The belt 16*a* is for instance a perforated steel belt, provided with a mesh on which the image side of the film is moving. The vacuum chamber 6 of course is now provided below the film and maintains the film in a flat position.

A sanding belt 17*a* is used for removing the paper residues, and this belt passes over shoe 18 which is adjustable in height. A belt of this type has been developed which can be adjusted with an accuracy of 1 μm so that it is possible to remove the paper residues completely without damaging the image in any way. The paper residues are removed through section 19, and the film which now has been completely freed of paper residues is passed through 14 for cutting off untreated edges and is then wound up at 15, as in FIG. 1. In this case no drying or other treatment is necessary anymore, and this embodiment allows a high production rate.

If desired, the removal of the paper residues may be further promoted in this embodiment by spraying steam on the surface to be treated, but of course, if the film then would leave the sending area in wet state, it still has to be dried again so that this embodiment although possible, normally will not be preferred.

What is claimed is:

1. A method of producing a self-supporting photographic emulsion having a thickness of less than 50 microns and bearing a positive photographic image, the method comprising the following steps:

(a) providing a photographic print having an image part of less than 50 microns in thickness and a backing paper;

(b) dividing the photographic print with the aid of a knife means into an photographic emulsion and backing paper, said divided emulsion retaining particles of said backing paper adhering thereto;

(c) passing the photographic emulsion having an image directed upwardly by conveyor means positioned above the photographic emulsion through vacuum means positioned above said conveyor means for maintaining of the photographic emulsion in a flat position through tank means positioned below said conveyor means and the photographic emulsion, said tank means containing a liquid for removal of particles of the backing paper from the photographic emulsion, whereby said particles are removed;

(d) cutting off untreated edges of the photographic emulsion and (e) drying the photographic emulsion in drying means.

2. The method of producing a self-supporting photographic emulsion bearing a positive photographic image according to claim 1 wherein said conveyor means has a belt containing a plurality of apertures going there through.

3. The method of producing a self-supporting photographic emulsion bearing a positive photographic image according to claim 1 wherein the step "C" further comprises spraying said liquid through a plurality of nozzles onto the photographic emulsion.

4. The method of producing a self-supporting emulsion bearing a positive photographic image according to claim 1 wherein the step "c" further comprises distributing the liquid on the photographic emulsion by at least one rotating brush.

5. The method of producing a self-supporting photographic emulsion bearing a positive photographic image according to claim 1 wherein the step "c" further comprises removing of remaining paper particles from the photographic emulsion by sanding means.

6. The method of producing a self-supporting photographic emulsion bearing a positive photographic image according to claim 1 wherein in the step "c" said liquid is an aqueous sodium hydroxide.

7. The method of producing a self-supporting photographic emulsion bearing a positive photographic image according to claim 6 wherein the step "c" further comprises rinsing a treated side of the photographic emulsion by a liquid.

8. The method of producing a self-supporting photographic emulsion bearing a positive photographic image according to claim 1 wherein, in the step "c", a volatile organic solvent is used with the liquid and distillation means is provided to recover said organic solvent.

* * * * *